United States Patent [19]

Waldo

[11] Patent Number: 4,599,815

[45] Date of Patent: Jul. 15, 1986

[54] PHOTOGRAPH DISPLAY WHEEL

[76] Inventor: Tim R. Waldo, 6542 Blain, Fremont, Mich. 49412

[21] Appl. No.: 646,691

[22] Filed: Aug. 31, 1984

[51] Int. Cl.[4] ..... A47B 49/00

[52] U.S. Cl. ..... 40/377; 40/530

[58] Field of Search ..... 40/379, 380, 377, 497, 40/494, 493

[56] References Cited

U.S. PATENT DOCUMENTS

| | | | |
|---|---|---|---|
| 2,493,167 | 1/1950 | Scholfield | 40/379 |
| 3,943,647 | 3/1976 | Holtsch | 40/377 |
| 4,165,575 | 8/1979 | Neilsen | 40/497 |
| 4,218,511 | 8/1980 | Todokoro | 40/497 |

FOREIGN PATENT DOCUMENTS

| | | | |
|---|---|---|---|
| 30146 | 12/1957 | Finland | 40/475 |

*Primary Examiner*—Gene Mancene
*Assistant Examiner*—Wenceslao J. Contreras
*Attorney, Agent, or Firm*—John E. Reilly

[57] ABSTRACT

A photograph display wheel is made up of a spindle having annular tracks, and a stand supports opposite ends of the spindle for rotation thereon. A ratchet-type control member at one end of the spindle limits the rotation of the spindle to one direction so that when protective jackets with enclosed photographs are mounted on the annular tracks of the spindle they are free to turn in one direction only so as to be supported for ease of viewing on the spindle.

12 Claims, 6 Drawing Figures

PHOTOGRAPH DISPLAY WHEEL

This invention relates to rotary or wheel-type filing and display devices; and more particularly to a novel and improved rotary device for mounting and displaying photographs and the like.

BACKGROUND AND FIELD OF THE INVENTION

Many types of filing and display devices for cards, photographs and similar articles are known in the prior art. For example, U.S. Pat. Nos. 2,731,966 to H. L. Neilsen and 3,959,903 to A. H. Schneider disclose rotary filing devices comprising spindles mounted for rotation on stands or bases and provided with rings or annular rails upon which the cards are mounted. U.S. Pat. Nos. 2,493,167 to R. P. Scholfield and 2,589,383 to R. B. Holt teach similar devices which further include a clutch assembly to limit rotation of the spindle to one direction. U.S. Pat. No. 2,046,655 to E. Scholfield et al utilizes a ratchet and pawl mechanism to accomplish the same purpose. U.S. Pat. Nos. 2,441,717 to F. P. Nero and 4,140,354 to A. Karper teach the use of stop or support elements which serve to prevent the cards from sliding under their own weight toward the underside of the spindle.

Although many advances have been made in the rotary display system art, there is yet to be provided a rotary display device which includes multi-functional elements capable of retaining a plurality of photograph jackets or the like in separate defined groups on the spindle while permitting a limited sliding movement of the jackets within their defined areas and further which stop and position the photograph for viewing as the spindle is turned in one direction.

SUMMARY OF THE INVENTION

An object of the present invention is to provide for a novel and improved photograph display wheel.

It is an additional object of the present invention to provide for a novel and improved device for displaying photographs and the like which includes means for mounting the photographs on a spindle and means for separating the photograph jackets placed on the tracks into distinct groups as well as acting as stops or supports to position the photographs for viewing while preventing the photographs from sliding out of view as the spindle is rotated.

A further object of the present invention is to provide for a novel and improved rotary display device for photographs and the like, wherein the spindle is restricted to rotation in one direction only so that the weight of the photographs does not cause the spindle to rotate in an undesired direction displaying the photographs already viewed.

It is a further object of the present invention to provide for a novel and improved spindle assembly for a rotary display device which when rotated is retained in a selected position without the assistance of the operator until the spindle is manually rotated again.

It is yet another object of the present invention to provide for a novel and improved simplified structure for a photographic display device which has a minimum number of parts and is inexpensive to produce.

In accordance with the present invention, there has been devised a rotary display device comprising a spindle member provided with annular tracks mounted in spaced outer concentric relation to the spindle. A stand or base supports opposite ends of the spindle, the spindle being journaled for rotation relative to the stand. Cooperating means on the stand at one end of the spindle are operative to restrict rotation of the spindle in one direction. More particularly, a ratchet member comprised of a plurality of radial beveled faces and shoulder elements is formed on the end of the spindle. A spring-loaded pin located in the stand in facing relation to the ratchet member on the spindle is biased to bear against the beveled faces. Upon rotation of the spindle in a first direction, the spring-loaded pin will travel along the beveled faces and over the shoulder element allowing relatively free rotation. However, upon rotation in the opposite direction, the springloaded pin will engage the shoulder element to prevent further rotation in that direction.

Protective photograph jackets are mounted on the annular rings or tracks on the spindle; the jackets are provided along one edge with slotted apertures which are deformable to allow insertion of the tracks into the apertures.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 1:
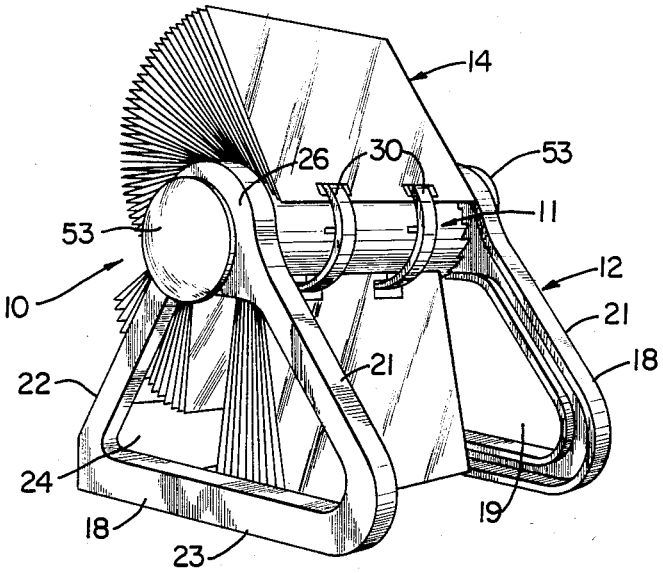
FIG. 1 is a perspective view of the display device of the present invention.
Figure 2:
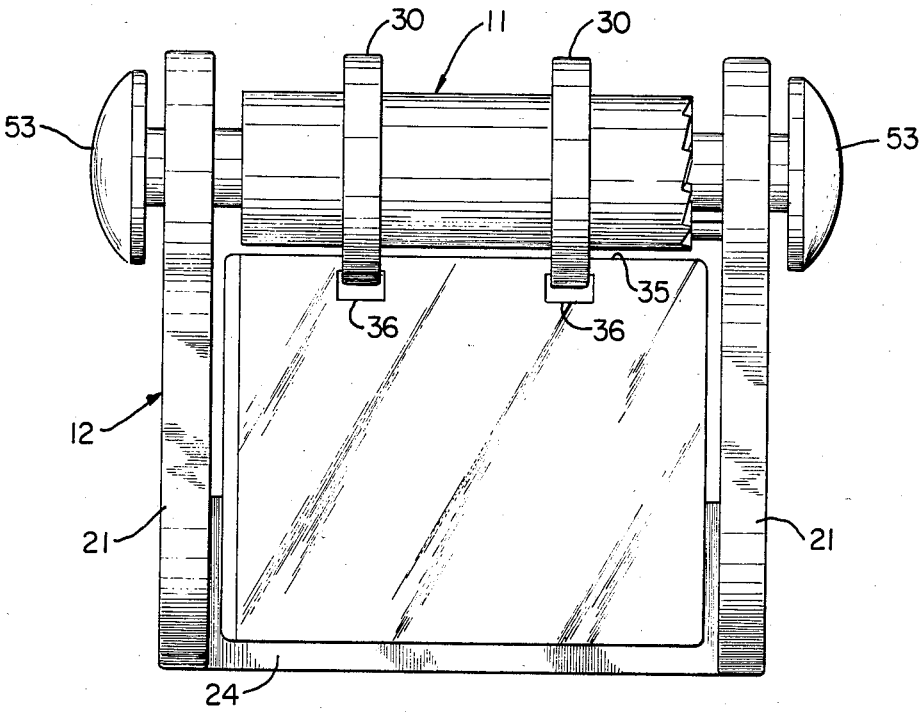
FIG. 2 is a front view in elevation of the display device.

Referring to the drawings in more detail and particularly FIGS. 1 and 2, a display device 10 comprises a hollow cylindrical spindle 11 mounted for rotation on a support stand 12. Photograph jackets 14 are shown attached to the spindle 11 and arranged for viewing. Stand 12 can be of any suitable configuration, but preferably comprises opposite generally triangular side portions 18, which may be provided with a cutout central portion to define front and rear legs 21, 22 and base 23. A rear brace portion 24 interconnects the rear legs 22 adjacent to the bases 23 to rigidify the entire structure.

Figure 3:
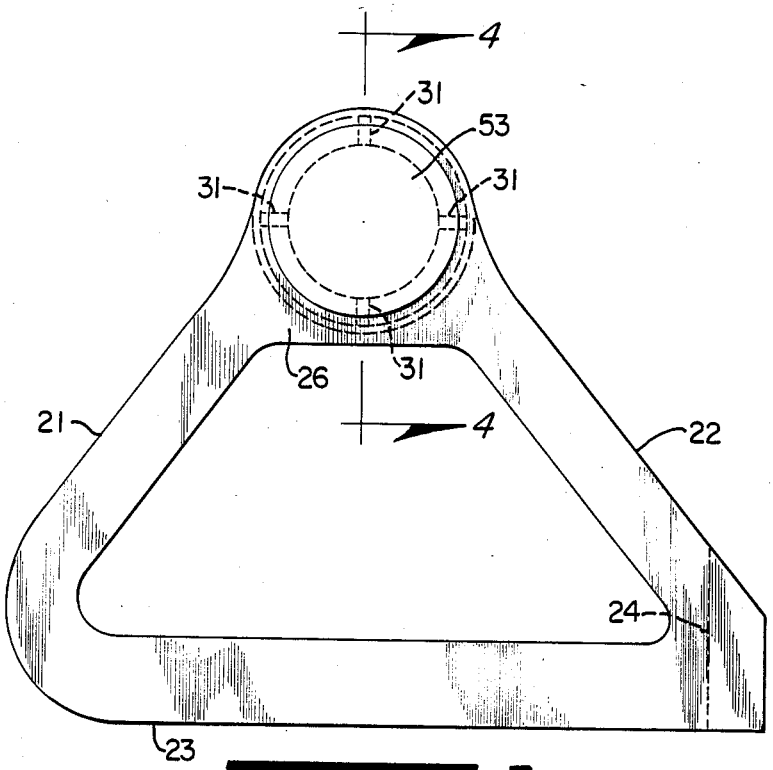
FIG. 3 is a side view in elevation illustrating the display stand and spindle with photographs removed.
Figure 4:
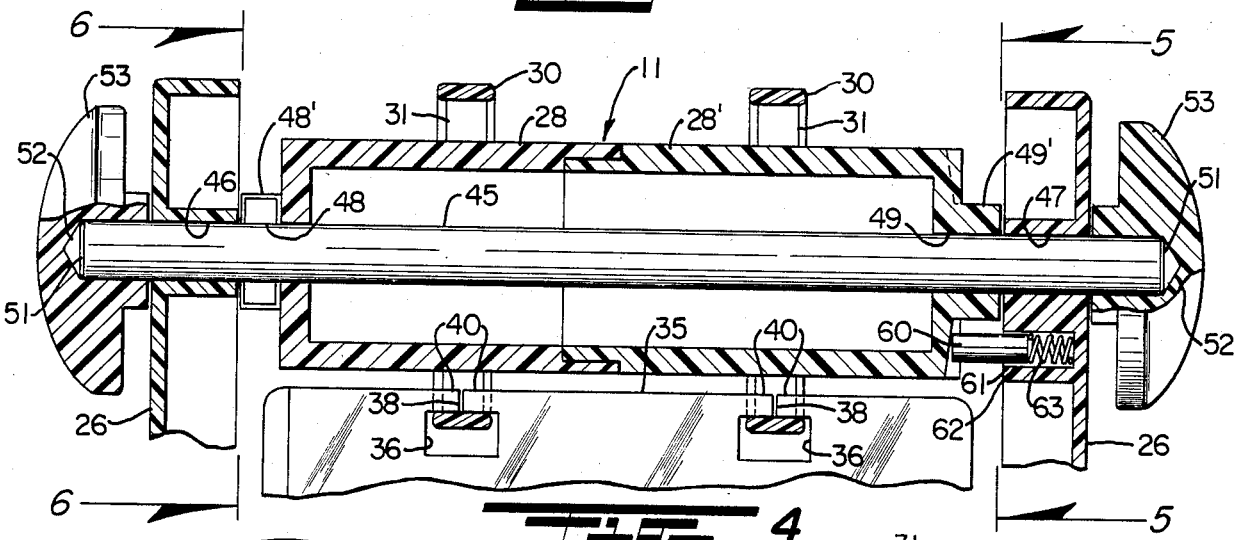
FIG. 4 is an enlarged detail view partially in cross-section taken along lines 4—4 of FIG. 3.

As illustrated in FIGS. 3 and 4, spindle 11 is manufactured in two complementary halves or sections 28, 28' interfitted together at a common center. An annular rail or track 30 is positioned in spaced outer concentric relation to each spindle section 28, 28' and is supported by radial spokes or lugs 31 projecting outwardly away from the surface of a respective spindle section 28, 28' at a point midway between the center and end of each section.

Referring to FIG. 4, photograph jackets 14 are composed of a somewhat flexible transparent material. Jackets 14 are provided along one edge 35 with spaced apertures 36 which are sized to be slightly larger than the width and depth of tracks 30 so that the jackets 14 do not bind against the track as the spindle is rotated. The jackets 14 are also provided with slotted portions 38 extending from edge 35 to apertures 36, each forming a pair of flaps 40 adjacent aperture 36. In order to install jackets 14 on tracks 30, flaps 40 are deformed in opposite directions away from each other to enlarge the openings formed by the slits 38 so that the tracks can be positioned within the apertures 36, as illustrated in FIG. 2.

Figure 5:
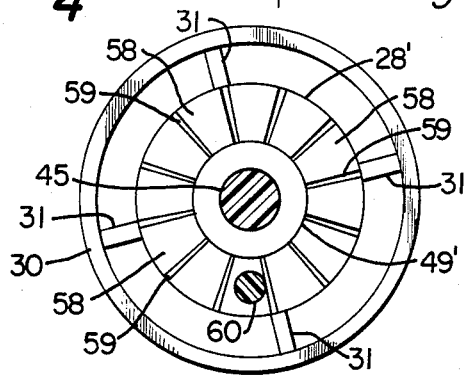
FIG. 5 is a cross-sectional view taken along lines 5—5 of FIG. 4.

As shown in detail in FIGS. 4 and 5, the spindle 11 is mounted on a stand 12 by means of a shaft 45 which extends through the spindle and is fixed against rotation with respect thereto. More particularly, shaft 45 is inserted through aligned apertures 46, 47 in the upper portions 26 of stand 12 and through apertures 48, 49 formed in reduced end portions or spacers 48', 49' at opposite ends of the spindle 11. Ends 51 of shaft 45 are inserted into press-fitting relation within recesses 52 of control knobs 53, so that the knobs 53 are fixed against rotation relative to the shaft. The knobs 53 serve as stops against lateral movement, retaining stand 12, shaft 45 and spindle 11 in connected relation, and further define manual actuating means for rotation of the shaft and spindle assembly to permit viewing of the photographic display.

Figure 6:
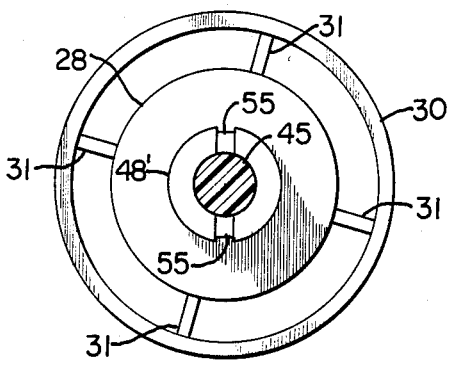
FIG. 6 is a cross-sectional view taken along lines 6—6 of FIG. 4.

As shown in FIG. 6, a reduced portion 48' of the spindle is provided with diametrically opposed radial channels 55, and the end portion 48' acts as a spacer between the stand and spindle, as does the reduced end portion 49' at the opposite end. The opposite end of spindle 11 is provided with a ratchet member comprised of alternating beveled or sloped surfaces 58 and shoulder members 59 disposed radially with respect to reduced portion 49'. A spring-loaded pin 60 is disposed within a recess 61 formed on the inwardly facing surface 62 of upper portion 26 of stand 12, immediately opposite the ratchet member. Referring to FIGS. 4 and 5, it will be seen that by virtue of the pin and ratchet arrangement, the spindle 11 can be rotated only in a counterclockwise direction; when so turned, the spring action of the spring 62 permits the pin to ride over the beveled surfaces 58 and shoulder members 59. However, when clockwise rotation is attempted, the next adjacent shoulder 59 will engage the pin 60 and prevent further rotation in that direction. Of course, the pattern of beveled surfaces and shoulder members on the ratchet can be reversed to permit clockwise rotation and prevent counterclockwise rotation.

In operation, photographs are inserted into the jackets 14, and the jackets are installed on the annular tracks 30 in the manner described above. The photographs on the wheel can be arranged into categories divided by the spokes or lugs 31 which connect the tracks in spaced concentric relation to the spindle. The knobs 53 are turned in a counterclockwise direction to rotate the spindle to a selected group of photographs positioned near the top of the spindle as shown in FIG. 1. When manual rotation ceases, the springloaded pin 60 will bear against the ratchet end of the spindle and one of the shoulders 59 will engage pins 60 to prevent further rotation of the spindle. The selected group of photographs may be supported from the rear by a spoke or lug 31 and will also be prevented from sliding rearwardly along the track so as to hang beneath the spindle. The photographs within the display group can be viewed quickly by slowly turning the knobs 53 in a counterclockwise direction, or can be flipped manually for more leisurely viewing. When it is desired to move to the next separate group of photographs, counterclockwise rotation is resumed and the abovementioned steps repeated. Photograph jackets 14 can be removed from the tracks 30 by twisting the jackets slightly along apertured edge 35 to deform the flaps 40 and enlarge the opening formed by the slits 38.

It is to be understood from the foregoing that various modifications, changes and adaptations may be made without departing from the scope of the present invention as defined by the following claims.

I claim:

1. A rotary display device for photographs and the like, comprising:

a rotatable spindle having annular tracks mounted in outer concentric relation to said spindle and a plurality of spindle-supporting spoke members projecting radially away from said spindle;

a stand supporting opposite ends of said spindle for axial rotation of said spindle relative to said stand, including a shaft member supporting said spindle on said stand and a control knob at one end of said shaft for manual rotation of said spindle;

cooperating means on said stand and one end of said spindle restricting rotation of said spindle in one direction, said cooperating means comprising a plurality of stop members in spaced circumferential relation to one another on said one end of said spindle, and a spring-loaded pin located in said stand in facing relation to said stop members, and means biasing said pin to travel yieldingly over said stop members when said spindle is rotated in a first direction and, when rotated in the opposite direction, to abut said stop members to prevent further rotation; and photograph-receiving jackets mounted on said annular tracks, each said jacket having slidable connector means for slidably connecting said jackets to said tracks.

2. A rotary display device according to claim 1, said stop members defined by alternating beveled surfaces and shoulder members formed on said one end of said spindle.

3. A rotary display device according to claim 1, said releasable connector means defined by spaced apertures adjacent an edge of each said jacket and slotted portions extending from said edge into communication with said apertures.

4. A rotary display device according to claim 3, said slotted portions forming deformable flaps between said edge of said jacket and each said aperture.

5. A rotary display device according to claim 1, said slidable connector means operative to slidably connect said jackets for slidable movement on said tracks between adjacent of said spoke members on each said track.

6. A rotary holder and display device for photographs, comprising:

a spindle having a shaft, annular tracks mounted in outer concentric relation to said spindle and a plurality of spoke members projecting radially between said spindle and said tracks, said spindle comprising a hollow cylindrical member, said shaft being inserted through said cylindrical member and fixed against rotation with respect thereto;

a stand portion supporting opposite ends of said shaft for rotation of said spindle relative to said stand;

cooperating means on said stand and one said end of said spindle restricting rotation of said spindle to one direction, said cooperating means comprising alternating beveled surfaces and shoulder members formed on said one end of said spindle, and a spring-loaded pin located in said stand in facing relation to said beveled faces and shoulders, said pin biased to travel yieldingly over said faces and shoulders when said spindle is rotated in a first direction and, when rotated in the opposite direction, to abut one end of said shoulder and prevent further rotation; and photograph-receiving jackets mounted on said annular tracks, each said jacket having an edge provided with slotted portions connecting said edge to apertures adapted, said tracks insertable through said slotted portions into said apertures.

7. A rotary holder and display device according to claim 6, said spindle including reduced portions at opposite ends thereof, said opposite ends of said shaft projecting outwardly from said reduced portions for connection to said stand portion.

8. A rotary holder and display device according to claim 6, one said end of said shaft including a control knob for manual rotation of said shaft.

9. A rotary holder and display device according to claim 6, said photograph-receiving jackets being composed of a transparent flexible material.

10. A rotary holder and display device according to claim 6, said slotted portions defining flaps between said edge and said apertures, said flaps being deformable from a normal coplanar relation in opposite directions whereby to permit insertion of said tracks into said apertures for limited slidable movement of said jackets along said tracks.

11. A rotary holder and display device according to claim 10, said flaps operative to return to said normal coplanar relation whereby to retain said tracks within said apertures, said slotted portions being sized to prevent passage of said radial spoke members therethrough whereby to limit slidable movement of said jackets on said tracks.

12. A rotary holder and display device for photographs, comprising:

an elongated, hollow cylindrical spindle 9 having reduced portions 48', 49' at opposite ends thereof, a shaft 45 disposed in inner concentric relation to said spindle 11 and fixed against rotation with respect thereto, opposite ends 51 of said shaft 45 projecting outwardly from said reduced portions 48', 49', and a ratchet member at one end of said spindle adjacent one said reduced portion 49', said ratchet member comprising a series of alternating shoulders 59 and sloped portions 58 disposed radially with respect to said reduced portion 49';

a pair of annular tracks 30, each mounted in spaced outer concentric relation to said spindle 11 by a plurality of spoke members 31 extending radially between said spindle 11 and said tracks 30;

a stand portion 12 comprising upright side portions 18 and control knobs 53 supporting said opposite ends 51 of said shaft 45 for manual rotation of said spindle 11 relative to said stand 12, and a spring-loaded pin 60 mounted in one said side portion 18 adjacent said ratchet member on said spindle 11 and biased outwardly to engage said ratchet member whereby said pin 60 is caused to yieldingly travel over said sloped portions 58 when said spindle 11 is rotated in a first direction, while being caused to abut one of said shoulders 59 to prevent further rotation when said spindle 11 is rotated in an opposite direction; and photograph-receiving jackets 14 composed of a flexible transparent material and mounted on said tracks 30, each said jacket 14 being of generally rectangular configuration having an edge 35 provided with slotted portions 38 connecting said edge 35 to a pair of apertures 36, said slotted portions 38 forming flaps 40 which are deformable to an out-of-the-way position to permit insertion of said tracks 30 through said slotted portions 38 into said apertures 36 for limited slidable movement of said jackets 14 along said tracks 30 between said spoke members 31.

* * * * *